US006349420B1

(12) United States Patent
Chiang

(10) Patent No.: US 6,349,420 B1
(45) Date of Patent: Feb. 26, 2002

(54) SWIMMING GOGGLE

(76) Inventor: Herman Chiang, 11F-2, No 634-9 Ching-Ping Rd., Chung-Ho City Taipei Hsien (TW)

( * ) Notice: Subject to any disclaimer, the term of this patent is extended or adjusted under 35 U.S.C. 154(b) by 0 days.

(21) Appl. No.: 09/705,130

(22) Filed: Nov. 1, 2000

(51) Int. Cl.[7] ..... A61F 9/02
(52) U.S. Cl. ..... 2/428; 2/441; 351/43
(58) Field of Search ..... 2/428, 430, 440, 2/441, 443, 452; 351/43

(56) References Cited

U.S. PATENT DOCUMENTS 4,279,040 A * 7/1981 Garofalo ..... 2/428
6,178,561 B1 * 1/2001 Cheng ..... 2/431

* cited by examiner

*Primary Examiner*—John J. Calvert
*Assistant Examiner*—Katherine Moran

(74) *Attorney, Agent, or Firm*—Pro-Techtor International Services

(57) ABSTRACT

The present invention discloses a swimming goggle comprising a lens frame, a padding member, a lens and a head strap, characterized in that the lens and the padding member are fixed as a whole piece with tight pressing engagement with the lens frame of such swimming goggle, wherein the lens frame comprising a frame having a bridging portion disposed at the center of the lens frame; an inlaid groove being disposed at the internal rim of the frame; and a suppressing means being disposed at the lateral side of the frame. Further, the padding member comprises a face fitting part and a lens retaining part, wherein the face fitting part attaches the upper section of the eyebrows and the lower section of the eye socket such that both eyes are cupped in the same enclosed space, and the lens retaining part can accommodate and mount the lens to the inlaid groove of the lens frame. The suppressing means can securely clip the lens and the padding member thereby providing a swimming goggle having the function of a mask, and providing better comfort without pressing hard on the wearer's eyeballs, and offering a wider vision for the wearer as well.

8 Claims, 7 Drawing Sheets

SWIMMING GOGGLE

BACKGROUND OF THE INVENTION

1. Field of the Invention

The present invention relates to a swimming goggle, more particularly to a swimming goggle of a novel structure comprising a padding member to cup both eyes in the same enclosed space, which gives better comfort and wider vision to the wearer.

2. Description of the Prior Art

The conventional swimming goggles designated for use in swimming pools regardless of their various types usually have two lenses, each of which separately cups the left and right eye sockets. In other words, the swimming goggle of the prior art incorporates the design of cupping the eye sockets to prevent water permeation. Therefore the padding members disposed on the lens frame regardless of the foamed ones or the suckers are independently assembled to the left lens and the right lens. After such conventional swimming goggle is worn, the padding member has an adsorption around the eye sockets near the eyeballs. It is still comfortable after wearing for a short time, however the eyes will be very uncomfortable due to the pressure when wearing the goggle for some time, especially in diving. In addition, the vision of the conventional goggle is very difficult to reach wide angles due to the small area of the lens. Of course, enlarging the lens is the most direct method to improve the shortcomings of the narrow angle for the vision, but once the lens frame is enlarged, the whole structure of the swimming goggle will be changed, and the comfortableness of wearing a larger frame becomes a new issue that has to be solved.

In view of the shortcomings and inconvenience of the prior art mentioned above, which are the subjects of improvements for a long time, hence the inventor of the present invention based on years of experience accumulated from the engagement in the related industry conducted extensive research to resolve the foregoing shortcomings and invented the present invention as disclosed below.

SUMMARY OF THE INVENTION

Therefore, the primary objective of the present invention is to provide a swimming goggle that offers better comfort and wider vision to the wearer. The swimming goggle comprising a padding member having the mask function that cups the eye socket beyond its area when wearing, both eyes are cupped in the same enclosed space, and we do not have to worry about the pressure acted on the eyeballs, and it further provides an airtight waterproof effect.

The swimming goggle of the present invention mainly features that the lens and padding member of the goggle are fixed as a whole piece by the pressing of the lens frame, and such lens frame comprising a first frame and a second frame wherein the first and second frames having a bridging portion coupled to the upper and lower edges at the center of the first and second frames, and the frames has an inlaid groove for clipping the lens and the padding member. Further, a suppressing means is disposed at the lateral sides of the first and second frames, in which the suppressing means comprises an axial base having an axial hole separately disposed on the first frame and the second frame; and for coupling and latching the axial holes in order to let the head strap of the swimming goggle to pass through, and the bottom casing and the front casing being mutually assembled as a piece, such that the tight pressing between the bridging portion, the bottom casing, and the front casing securely mount the lens and the padding member into the inlaid groove of the lens frame.

Further, according to the above features, wherein the bridging portion comprises a latch groove on a first frame, and a latch post on a second frame, such that the central section of the first frame and that of the second frame can be latched together as a piece.

Further, according to the above features, wherein the bottom casing has an inclined post for hooking the axial hole of the first frame and that of the second hole as a whole piece, and the front panel in corresponsive to the inclined axial post has a latch hole to mutually latch the inclined axial post. In addition, there is a passing through area for the head strap adjacent to the inclined axial post, and such passing through area is divided into two parts for allowing the head strap of the swimming strap to revolve and pass through.

Another feature of the present invention is that the bottom casing and the front panel are pivotally coupled into the axial hole which allows a small angled rotation for meeting the need for wearing by different users.

To make it easier for our examiner to understand the objective of the inventions structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
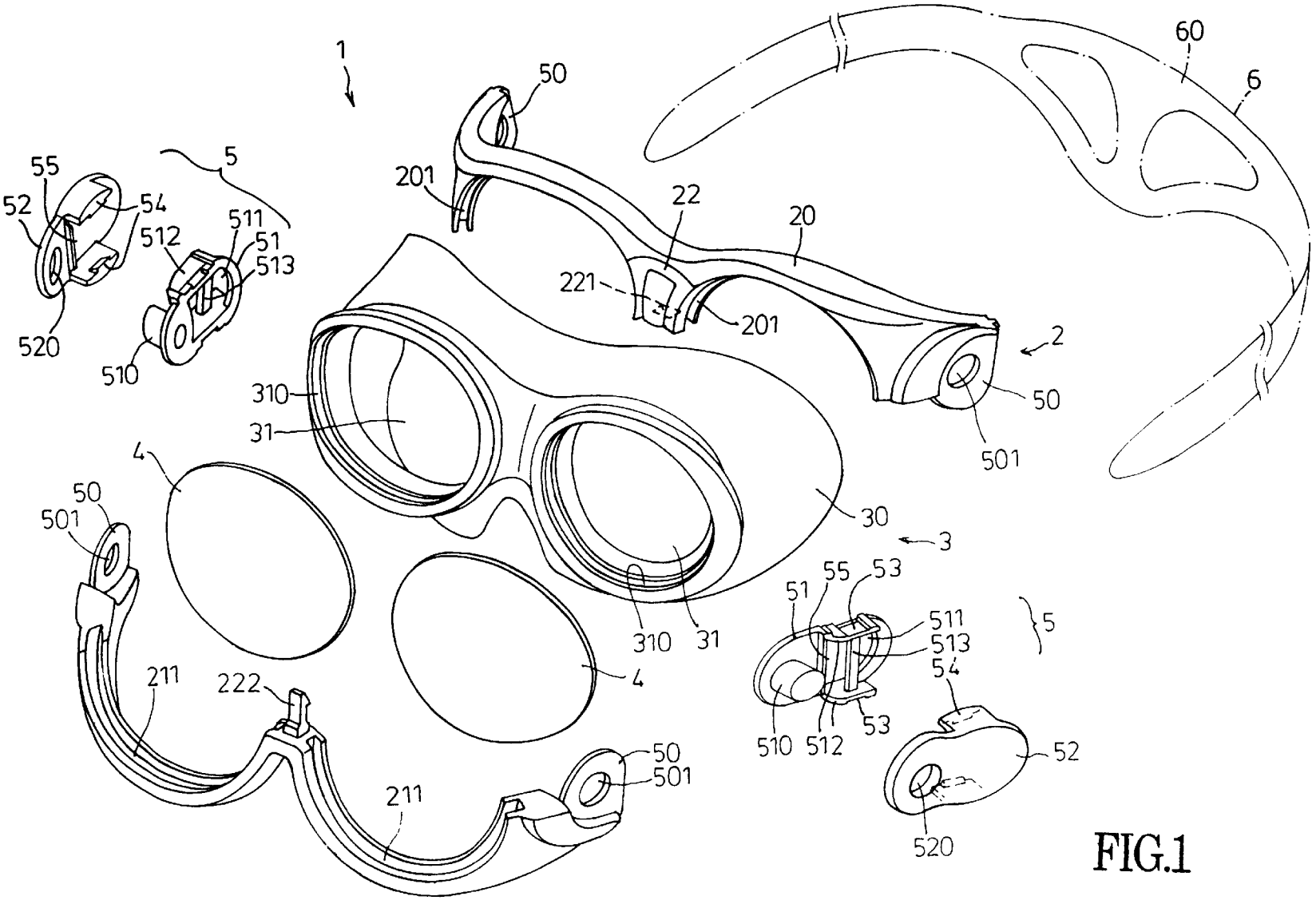
FIG. 1 shows a three-dimensional diagram of the disassembled parts of the swimming goggle of the present invention.
Figure 6:
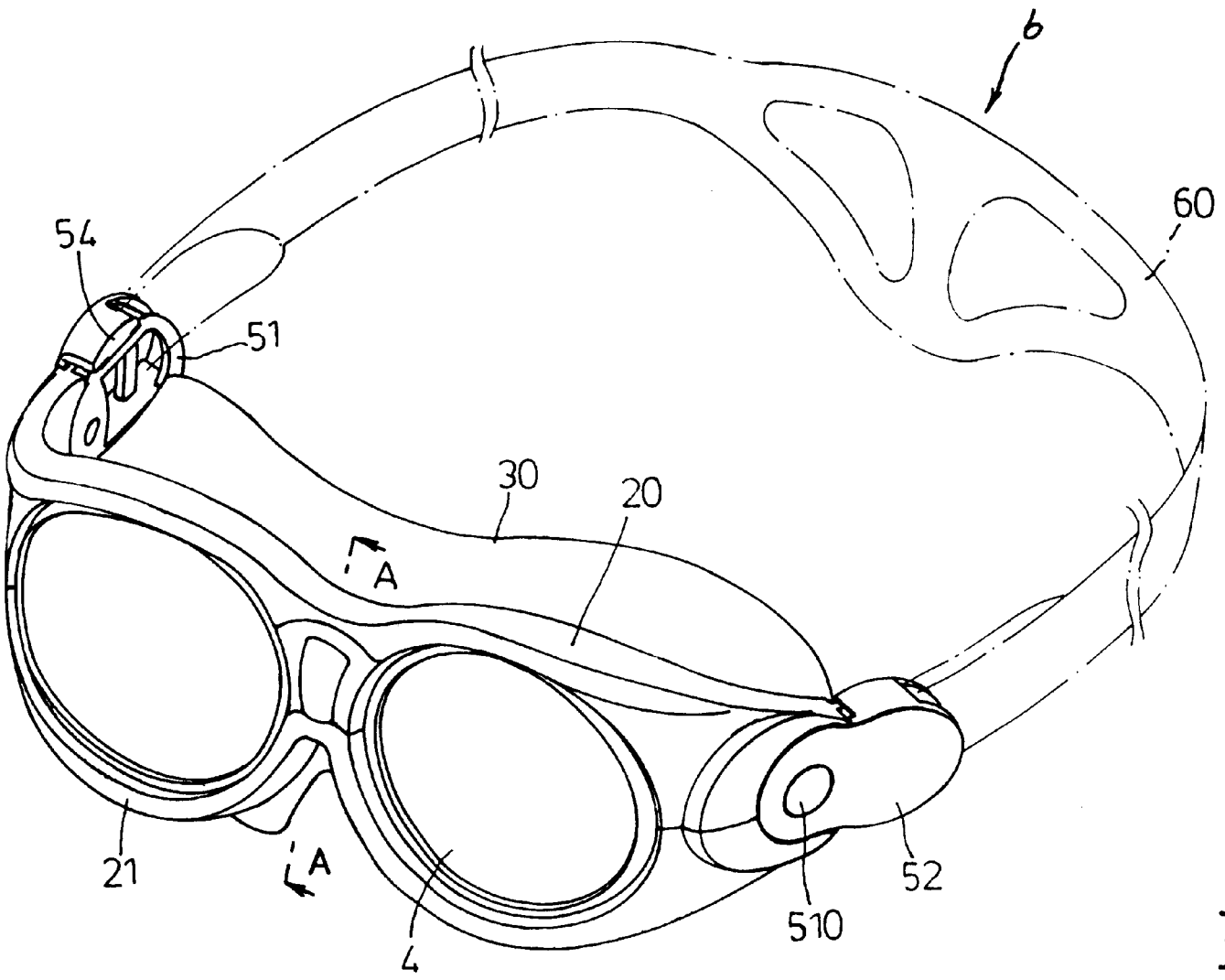

Please refer to FIG. 1, the swimming goggle comprises a lens frame 2, a padding member 3, a lens 4, a suppressing means 5, and a head strap device 6 (see FIG. 6), wherein the lens frame 2 is formed by tightly assembling a M-shaped first frame 20 and a corresponding second fame 21. The upper edge and the lower edge at the central section of both first and second frames are coupled to form a bridging portion, and such bridging portion comprises a latch groove 221 and a latch post 222 in which the latch groove 221 being disposed on the first frame 20 and the latch post 222 being extended from the second frame 21 such that the latch groove 221 and the latch post 222 can latch the middle section of the first frame 20 and that of the second frame 21 together as a piece, and the bridging portion 22 separates the lens frame 2 into the left and right portion. An inlaid portion 201, 211 is disposed each on the inner rim of the left frame and the right frame for retaining the lens 4 and the padding member 3.

The padding member 3, having a face fitting part 30 and a lens retaining part 31, of which the face fitting part is of large area and its upper edge attaches the upper portion of the eyebrow, and the lower edge attaches the lower portion of the eye socket of the wearer. The lens retaining portion 31 forms a frame opening on the padding member 3 in corresponsive to the size of the lens. The periphery of the frame opening has an indented ring 310 for covering the periphery of the lens 4 and being accommodated in the inlaid groove 201 of the lens frame.

Furthermore, a suppressing means 5 is disposed on each of the lateral sides of the lens frame 2, and the lens frame 2 comprises an axial base 50, bottom casing 51, and front panel 52, wherein the axial base 50 is disposed each on the first frame 20 and the second frame 21, and each axial base 50 has an axial hole 501 on it for coupling. The bottom casing 51 has an inclined axial post 510 on a lateral side of the panel for coupling the foregoing axial hole 501, and the passing area formed at the adjacent side of the inclined axial post 510 is for the head strap to pass through, and a hollow portion 511 being disposed in the passing through area at the bottom casing, and a platform 512 being longitudinally disposed on both lateral sides, and an isolating post 513 being disposed across the platform 512 such that the head strap can be fixed by revolving around and passing through the isolating post 513. The front panel 52 has a latch hole 520 being latched with the inclined axial post 510. In addition, the outer side of the platform 512 of the bottom casing 51 has an inlaid groove 53, and the front panel 52 has a inlaid post 54 being extended from the position corresponding to the inlaid groove 53 such that the two can be securely assembled together as a piece. Further, the front panel 52 and the bottom casing 51 has a blocking surface 55 for guiding the head strap and restricting excessive passing through of the head strap in their corresponding inner sides.

Figure 2:
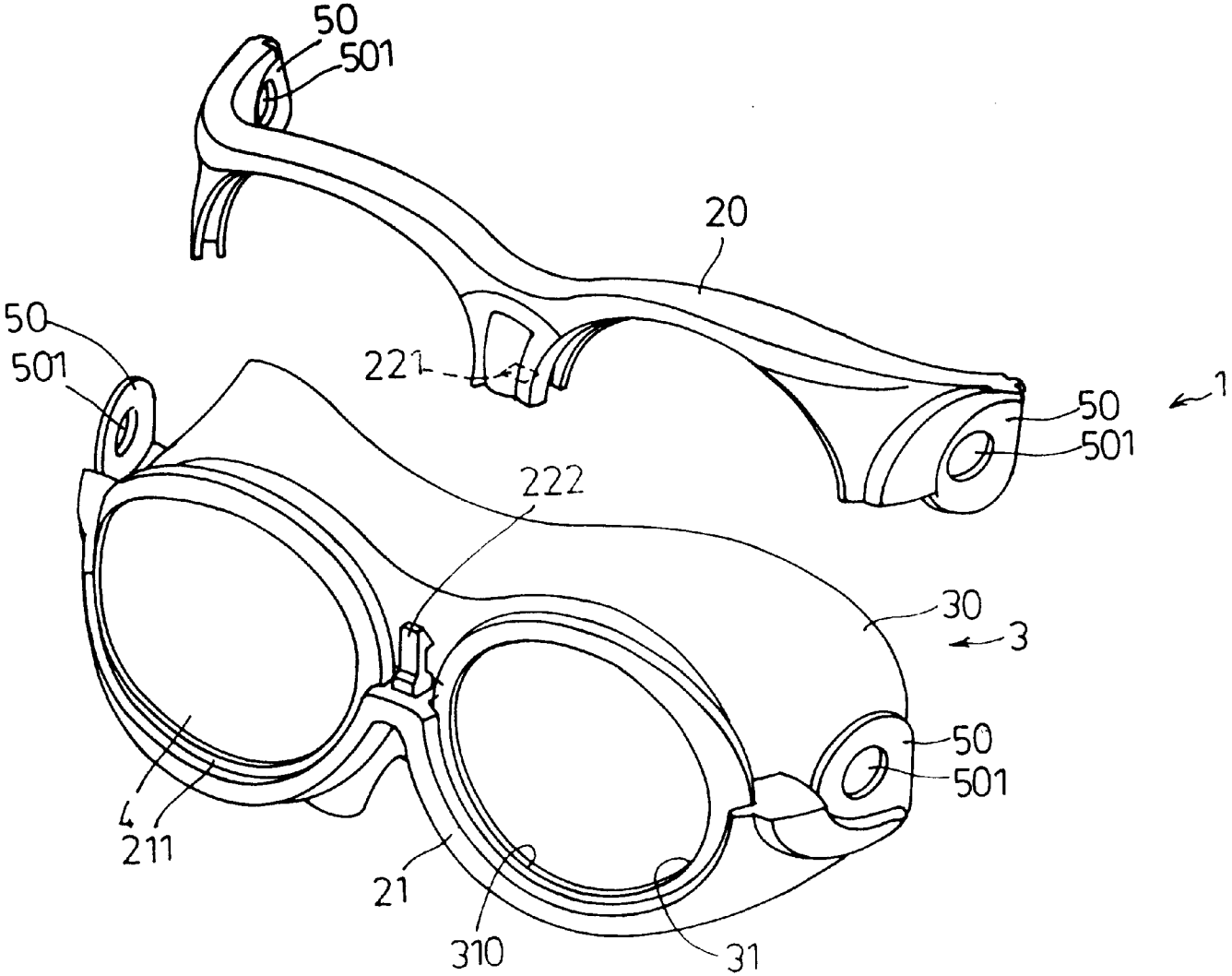
FIG. 2, FIG. 3, FIG. 4, FIG. 5, and FIG. 6 show the three-dimensional diagrams of a series of step-by-step assembly process of the swimming goggle according to the present invention.
Figure 3:
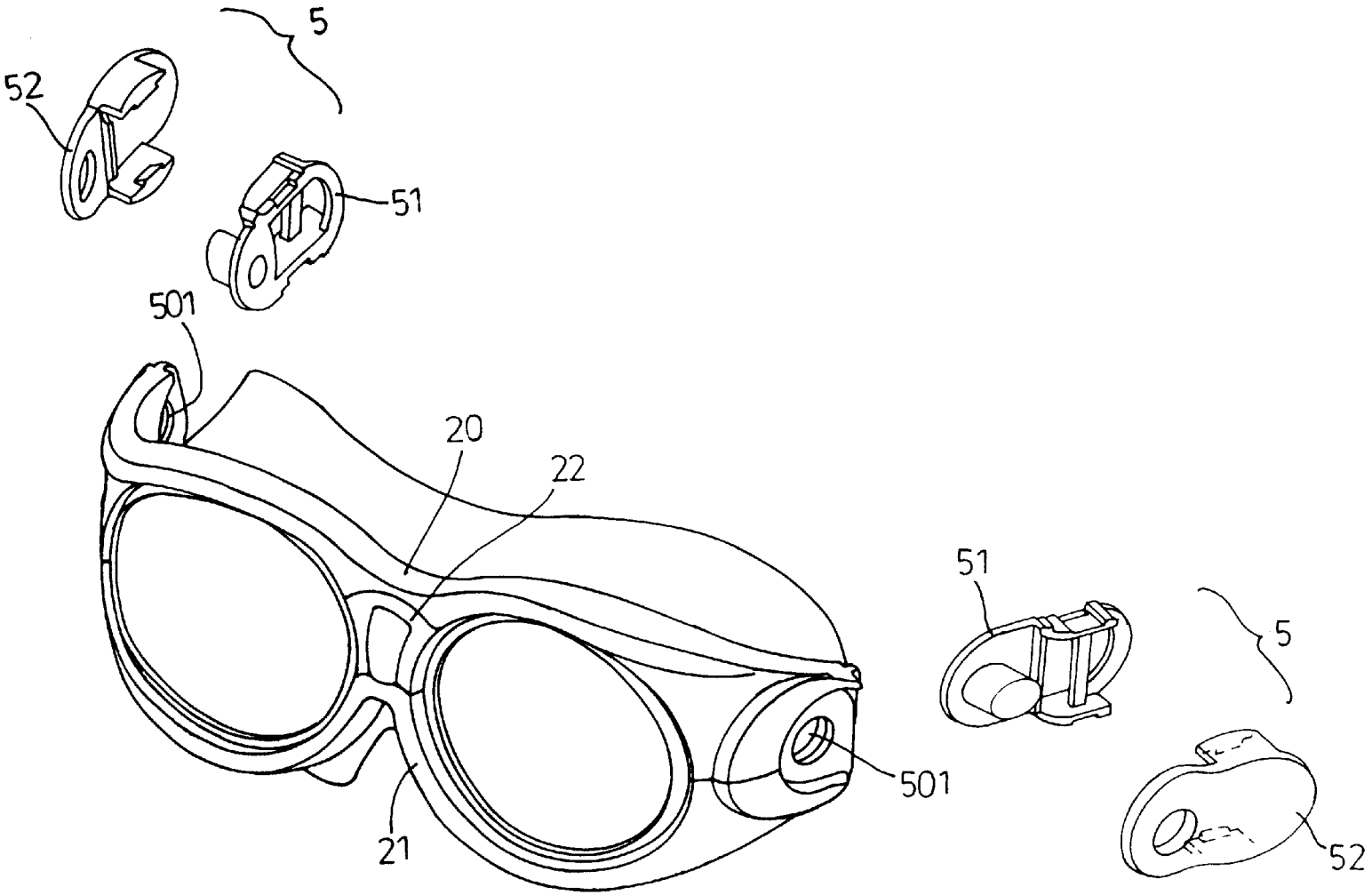
Figure 4:
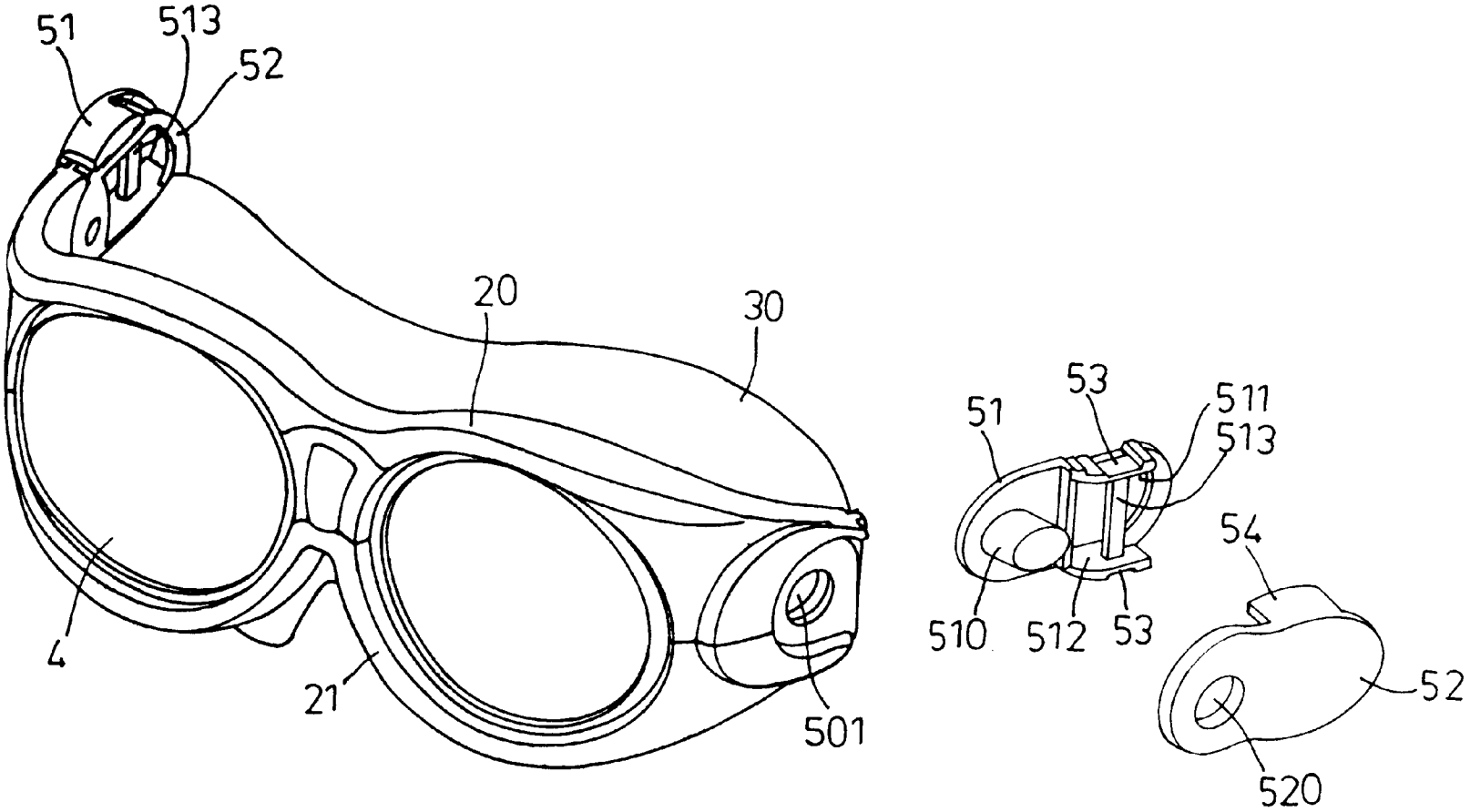
Figure 5:
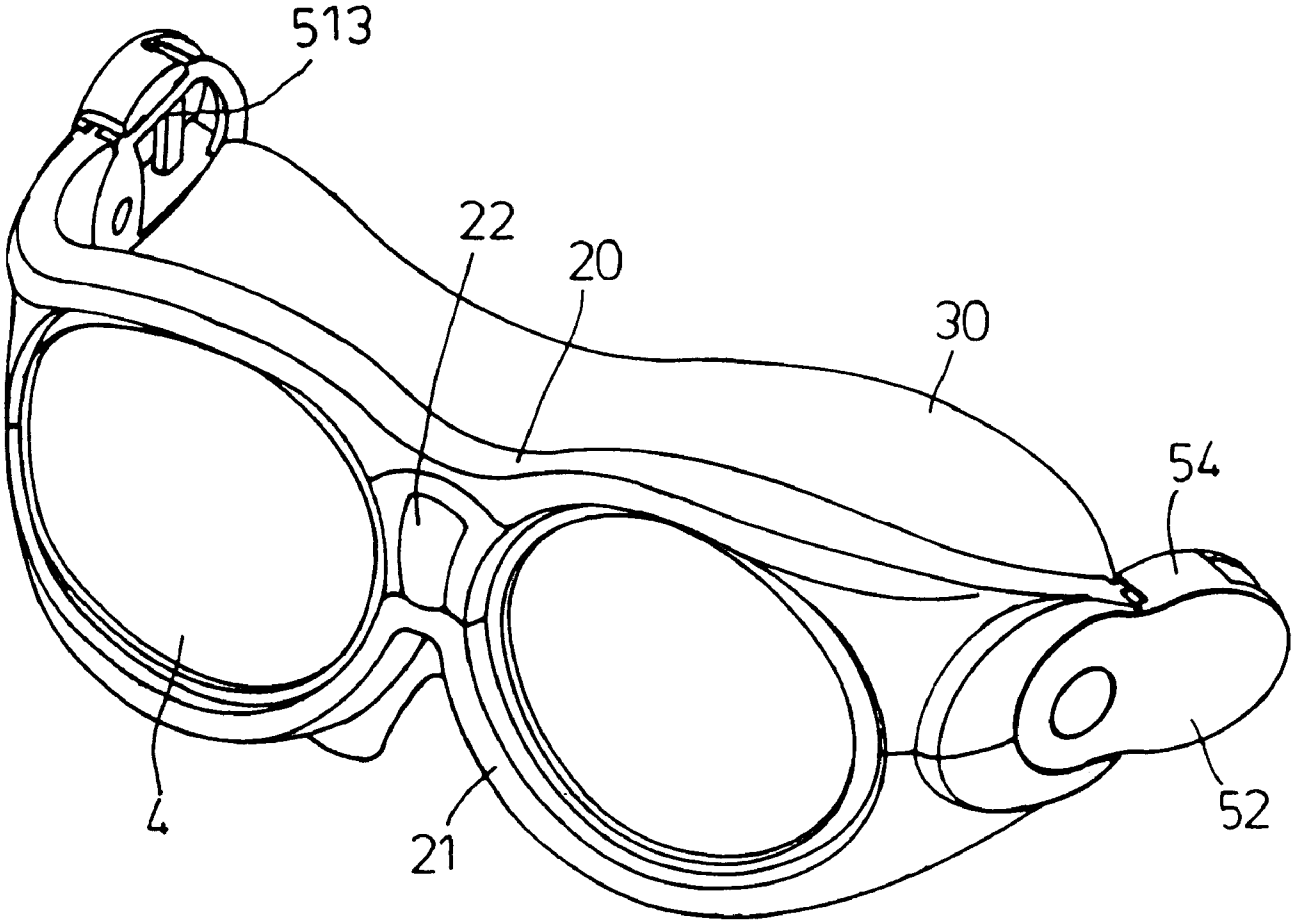
Figure 7:
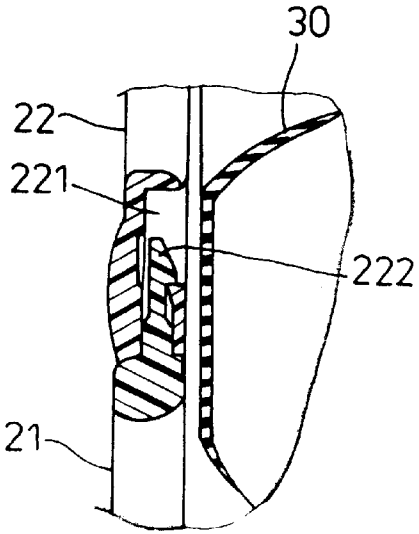
FIG. 7 is the cross-sectional diagram of the A—A section of FIG. 6.

Please continue to refer to FIGS. 2 to 6, which illustrate the three-dimensional diagrams of a series of assembling steps. Firstly, install the lens 4 into the indented ring 310 of the lens retaining portion 31 of the padding member 3, and then install it into the inlaid groove 211 of the second frame 21 as shown in FIG. 2. Latch the latch post 222 on the second frame 21 by the first frame 20 into the latch groove 221 (please refer to FIG. 7), and securely couple the central portion of the rim of the frame as shown in FIG. 3. Hook the axial hole 501 on the lateral side of the first frame 20 and the second frame 21 by the inclined axial post 510 in a lateral side of the bottom casing 51, and use the latch hole 520 of the front panel 52 and the inlaid post 54 to latch into the inclined axial post 510 of the bottom casing 51 and the inlaid groove 53 thereby fixing a lateral side of the swimming goggle by pressing as shown in FIG. 4. Similarly, the other lateral side can be assembled in the same way to securely latch the front panel 52 and the bottom casing 51 in order to fix the other lateral side by pressing as shown in FIG. 5. Finally, each of both ends of a head strap 60 of a head strap device 6 separately passes through the assembled front panel 52 and the bottom casing 51, and the head strap 60 is being blocked by the blocking surface 55 during the head strap 60 is being passed through (refer to FIG. 1), and the head strap will be guided to revolve and pass through the isolating post 513 of the bottom casing 51 (refer to FIG. 1) so that the head strap is fixed in position as shown in FIG. 5.

Figure 8:
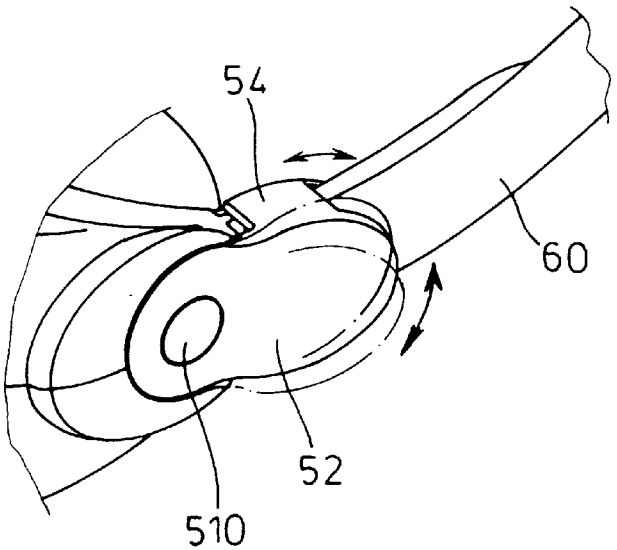
FIG. 8 show a three-dimensional diagrams after the head strap is being fixed at the bottom casing and the front casing, it could rotates according to the present invention.

Please continue to refer to FIG. 8. After the head strap 60 is being fixed at the bottom casing 51 and the front casing 52, it rotates along the inclined axial post 510 as an axis in order to meet different wearer's need for the head strap lengths.

Therefore, in summation of the above description, the present invention obviously attains the objective of the present invention. The inventor of the present invention based on years of experience in the related industry conducted extensive research to enhance the structure of the present invention herein which is hereby submitted for patent application.

While the invention has been described in what is considered the most practical and preferred embodiments, it is understood that the invention is not limited to the disclosed embodiments, but is intended to cover various modifications and similar arrangements and procedures within the spirit and scope of the broadest interpretation and equivalent arrangements, modifications, and procedures.

Numbering of the Major Elements

| | | | |
|---|---|---|---|
| Swimming goggle | 1 | | |
| Lens frame | 2 | First frame | 20 |
| Second frame | 21 | Bridging portion | 22 |
| Inlaid groove | 211 | Latch groove | 221 |
| Latch post | 222 | | |
| Padding member | 3 | | |
| Face fitting portion | 30 | Lens retaining portion | 31 |
| Indented ring | 310 | | |
| Lens | 4 | | |
| Suppressing means | 5 | | |
| Axial base | 50 | Bottom casing | 51 |
| Front panel | 52 | Inlaid groove | 53 |
| Inlaid post | 54 | Blocking surface | 55 |
| Inclined axial post | 510 | Hollow portion | 511 |
| Platform | 512 | Isolating post | 513 |
| Latch hole | 520 | Axial hole | 501 |
| Head strap device | 6 | | |
| Head strap | 60 | | |

What is claimed is:

1. A swimming goggle, comprising:

a lens frame, further having an inlaid groove being disposed at an internal rim of the lens frame, a bridging portion disposed at the center of the lens frame, and a suppressing means disposed at a lateral side of the lens frame, and said suppressing means comprising axle base having an axial hole on the lens frame, and a passing latch being coupled into the axial hole and for allowing a head strap to pass through the axial hole such that a bottom casing and a front panel are assembled as a whole piece;

a padding member, further comprising a face fitting part and a lens retaining part;

a lens, for being retained in the lens retaining part of the lens frame and being accommodated in the inlaid groove of the lens frame altogether; and a head strap device, comprising a head strap being disposed at the lateral sides of the lens frame.

2. A swimming goggle as claimed in claim 1, wherein said lens frame is assembled by coupling the upper and lower portions of a first frame and a second frame.

3. A swimming goggle as claimed in claim 2, wherein said bridging portion comprises a latching groove being disposed on the first frame, and a latching post being disposed on the second frame, and the middle part of the first and the second lens frames are latched together as a whole piece.

4. A swimming goggle as claimed in claim 3, wherein said bottom casing has an inclined axial post being disposed on a lateral side of the panel such that it hooks into the axial holes of the first and second frames, and a corresponding latch hole being disposed on a front panel for latching the inclined axial post.

5. A swimming goggle as claimed in claim 4, wherein a hollow portion is disposed adjacent to the inclined axial post of said bottom casing, and a platform being longitudinally disposed on both lateral sides, and an isolating post disposed across the platform for being revolved around and passed through by the head strap of the swimming goggle.

6. A swimming goggle as claimed in claim 5, wherein said bottom casing and the front panel being assembled together as a whole piece, and an inlaid groove being disposed on the outer side of the platform at the bottom casing, and an inlaid post being extended from a position corresponding to said inlaid groove such that the two are securely inlaid into each other as a whole piece.

7. A swimming goggle as claimed in claim 6, wherein the face fitting part of said padding member attaches the upper portion of the eyebrow and the lower portion of the eye socket of the wearer.

8. A swimming goggle as claimed in claim 7, wherein the inner side of said front panel and bottom casing has a blocking surface at the corresponding position for guiding and the head strap to pass through and restricting excessive passing through.

* * * * *